US009895703B1

(12) United States Patent
Hsieh

(10) Patent No.: US 9,895,703 B1
(45) Date of Patent: Feb. 20, 2018

(54) SPRINKLER

(71) Applicant: Yuan Pin Industrial Co., Ltd., Mo-Mei Township, Chang-Hua County (TW)

(72) Inventor: Ming-Chih Hsieh, Mo-Mei Township (TW)

(73) Assignee: Yuan Pin Industrial Co., Ltd., Ho-Mei Township (TW)

( * ) Notice: Subject to any disclaimer, the term of this patent is extended or adjusted under 35 U.S.C. 154(b) by 0 days.

(21) Appl. No.: 15/424,945

(22) Filed: Feb. 6, 2017

(51) Int. Cl.

| | |
|---|---|
| ***B05B 1/30*** | (2006.01) |
| ***B05B 9/01*** | (2006.01) |
| ***B05B 12/00*** | (2006.01) |
| ***B05B 1/16*** | (2006.01) |
| ***B05B 15/06*** | (2006.01) |

(52) U.S. Cl.
CPC ..... *B05B 1/1645* (2013.01); *B05B 1/169* (2013.01); *B05B 1/3026* (2013.01); *B05B 9/01* (2013.01); *B05B 12/002* (2013.01); *B05B 15/061* (2013.01)

(58) Field of Classification Search
CPC ..... B05B 1/1645; B05B 1/169; B05B 1/3026; B05B 9/01; B05B 12/002; B05B 15/061
USPC ..... 239/525, 526, 581.1
See application file for complete search history.

(56) References Cited

U.S. PATENT DOCUMENTS

| | | | | |
|---|---|---|---|---|
| 4,997,131 | A * | 3/1991 | Heren | B05B 9/01 239/397.5 |
| 6,536,688 | B1 * | 3/2003 | Chun-Lee | B05B 1/3026 239/525 |
| 7,240,858 | B2 * | 7/2007 | Wang | B05B 1/3013 239/395 |
| 8,490,948 | B2 * | 7/2013 | Lu | A01G 25/00 239/526 |
| 8,496,190 | B2 * | 7/2013 | Chen | B05B 9/01 239/394 |
| 8,596,558 | B2 * | 12/2013 | Lai | B05B 1/3026 239/525 |
| 2006/0249599 | A1 * | 11/2006 | Guo | B05B 1/3013 239/530 |
| 2010/0264238 | A1 * | 10/2010 | Wang | B05B 1/1654 239/525 |
| 2010/0320295 | A1 * | 12/2010 | Mang | B05B 1/18 239/562 |
| 2011/0127356 | A1 * | 6/2011 | Hsu | B05B 9/01 239/526 |

(Continued)

*Primary Examiner* — Darren W Gorman
(74) *Attorney, Agent, or Firm* — Alan D. Kamrath; Kamrath IP Lawfirm, P.A.

(57) ABSTRACT

A sprinkler includes a handle, a nozzle, a tube, a valve and a switch. The nozzle is connected to the handle. The tube is made in the handle and includes a window, a main channel in communication with a channel made in the nozzle, and an extensive channel in communication with the main channel via an intersection. The valve includes a gate, a positioning portion formed on the gate, and a connective portion formed on the positioning portion. The valve is rotationally inserted in the main channel so that the connective portion extends out of the tube. The switch includes an arched wall, a fin formed on an arched face of the wall, and a connector formed on an upper edge of the wall and connected to the connective portion of the valve so that the switch is movable with the valve. The fin is movable in the window.

10 Claims, 11 Drawing Sheets

(56) References Cited

U.S. PATENT DOCUMENTS

2015/0343467 A1* 12/2015 Chen ..... B05B 9/01
239/526

* cited by examiner

SPRINKLER

BACKGROUND OF INVENTION

1. Field of Invention

The present invention relates to gardening and, more particularly, to a sprinkler for gardening.

2. Related Prior Art

A typical sprinkler includes a valve inserted in a handle and operatively connected to a button, lever or switch supported on the handle so that the button, lever or switch is operable to control the valve. The button or lever is pressed or the switch is slid to open the valve to allow water to go out of the sprinkler. However, the button, lever or switch can be operated by mistake for sticking out of the handle. The valve is specifically made for a certain model of sprinkler, and so is the button, lever or switch. Hence, the costs for making the sprinkler-specific valve and the button, lever or switch are high. Different models of sprinklers require different assembly processes for including different valves and buttons, levers or switches. Therefore, the cost of assembling the sprinkler is high. Moreover, different assembly processes mean less familiarity and lower precision.

The present invention is therefore intended to obviate or at least alleviate the problems encountered in prior art.

SUMMARY OF INVENTION

It is an objective of the present invention to provide a sprinkler with a neat profile.

It is another objective of the present invention to provide a sprinkler for providing water at a continuously adjustable It is another objective of the present invention to provide a simple, easy-to-make, easy-to-use and reliable sprinkler.

To achieve the foregoing objectives, the sprinkler includes a handle, a nozzle, a tube, a valve and a switch. The nozzle is connected to the handle. The tube is made in the handle and includes a window, a main channel in communication with a channel made in the nozzle, an extensive channel, and an intersection via which the extensive channel is in communication with the main channel. The valve includes a gate, a positioning portion formed on the gate, and a connective portion formed on the positioning portion. The valve is rotationally inserted in the main channel so that the connective portion extends out of the tube. The switch includes an arched wall, a fin formed on an arched face of the wall, and a connector formed on an upper edge of the wall and connected to the connective portion of the valve so that the switch is movable with the valve. The fin is movable in the window. The gate completely blocks the intersection as the fin is located in an end of the window. The gate completely opens the intersection when the fin is located in another end of the window. The gate partially opens the intersection as the fin is located between the ends of the window.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
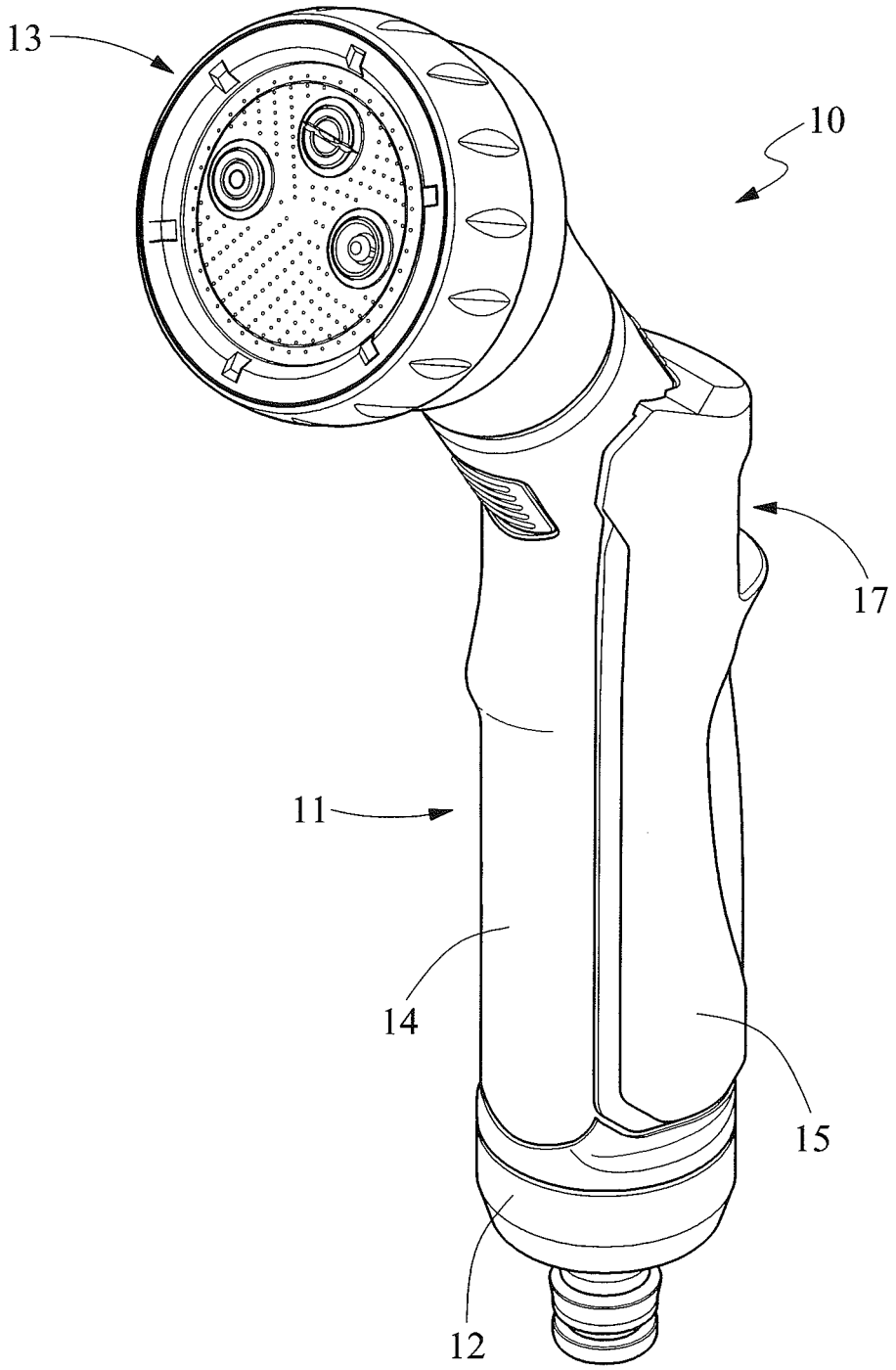
FIG. 1 is a perspective view of a sprinkler according to the preferred embodiment of the present invention.

Referring to FIG. 1, a sprinkler 10 includes a handle 11, a valve 30 and a switch 40 according to the preferred embodiment of the present invention. The handle 11 is connected to a joint 12 at a lower end and connected to a nozzle 13 at an upper end. The handle 11 includes two shells 14 and 15 joined together to define a hollow configuration.

Figure 2:
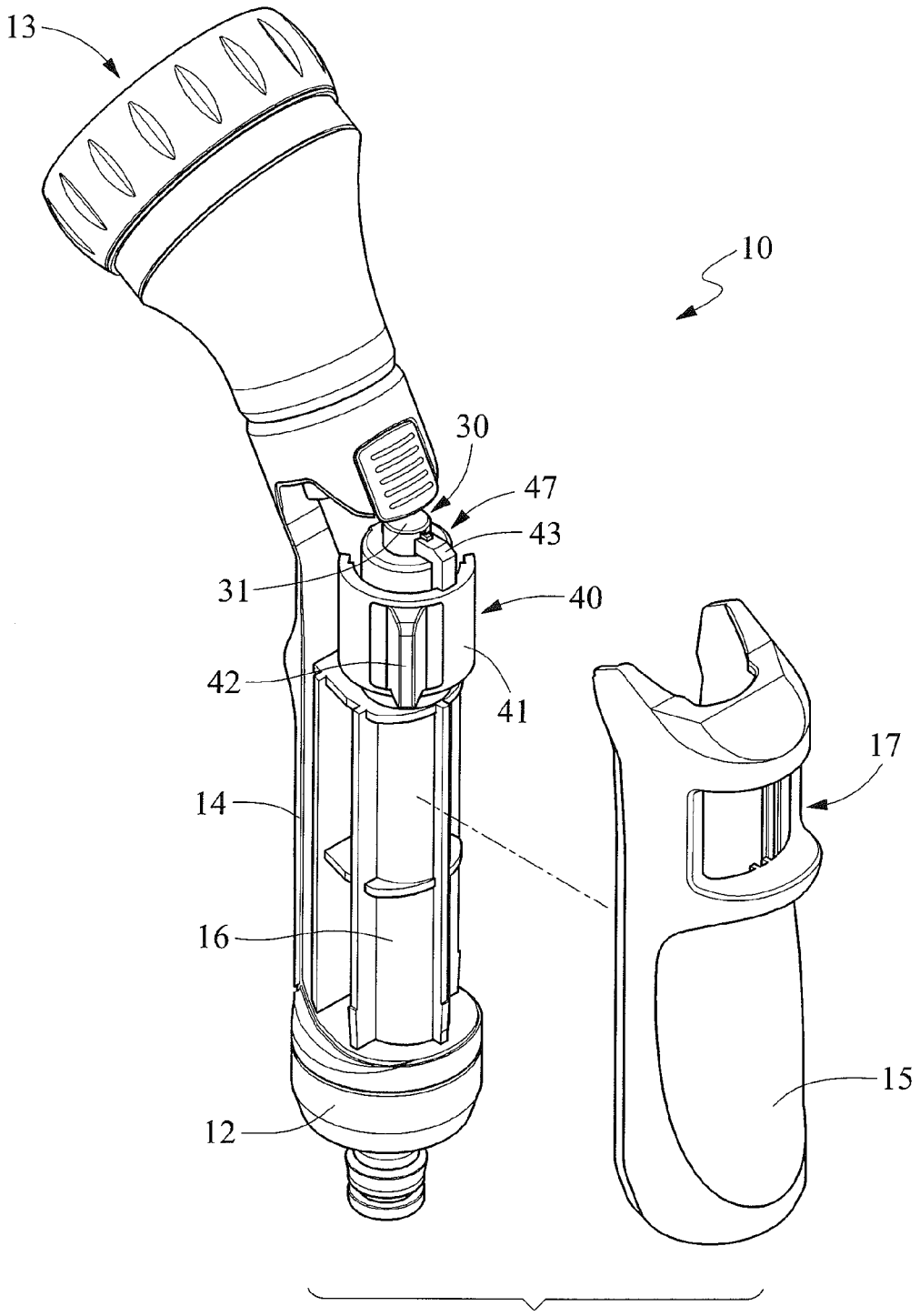
FIG. 2 is a rear exploded view of the sprinkler of FIG. 1.

Referring to FIG. 2, the first shell 14 is formed with a tube 16 extending therein in the handle 11 when the shells 14 and 15 are joined together. The second shell 15 is made with a window 17. The valve 30 is connected to an upper end the tube 16. The switch 40 is exposed to the exterior of the handle 11 via the window 17.

Figure 3:
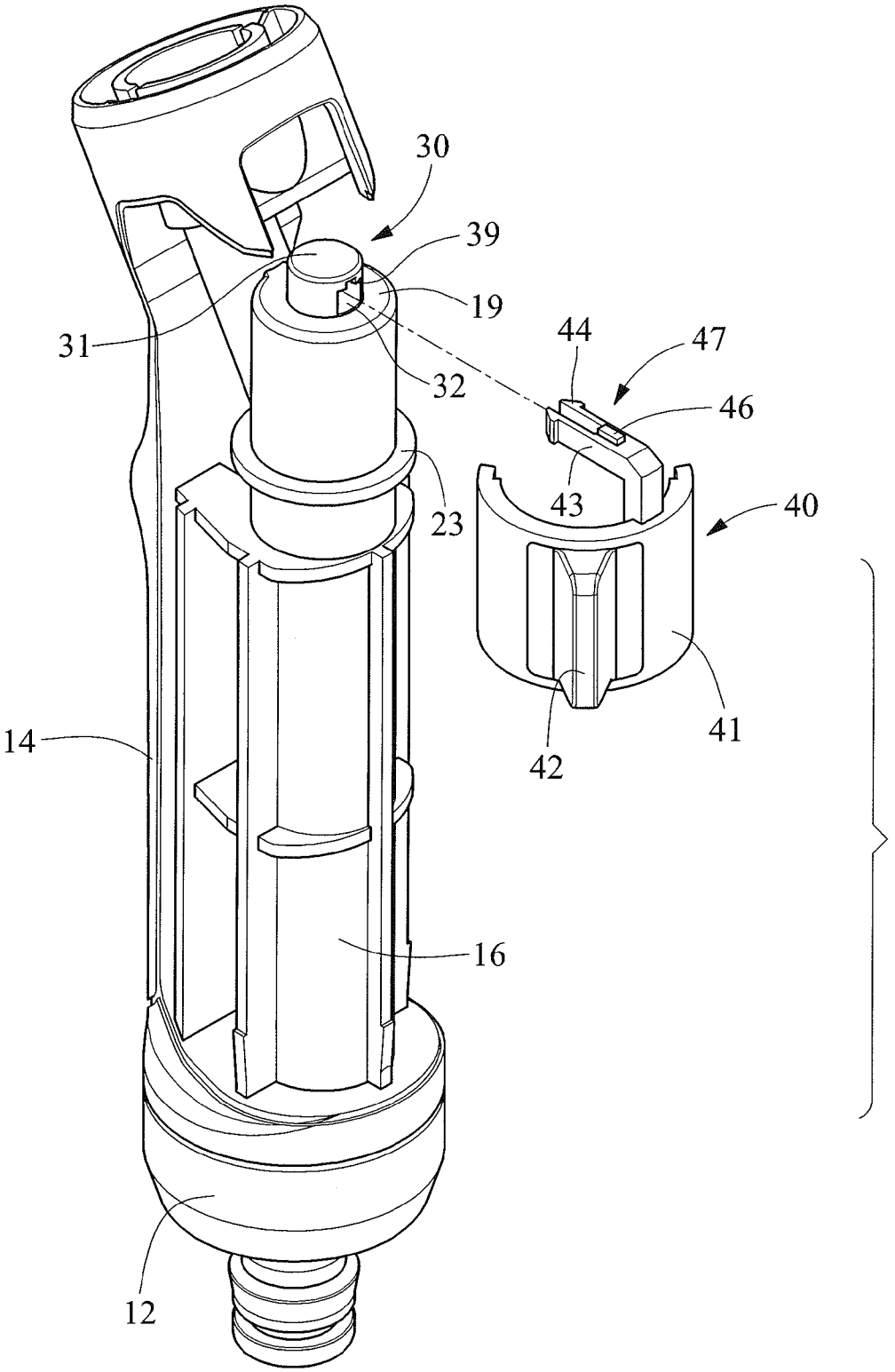
FIG. 3 is a partial view of the sprinkler shown in FIG. 2.
Figure 4:
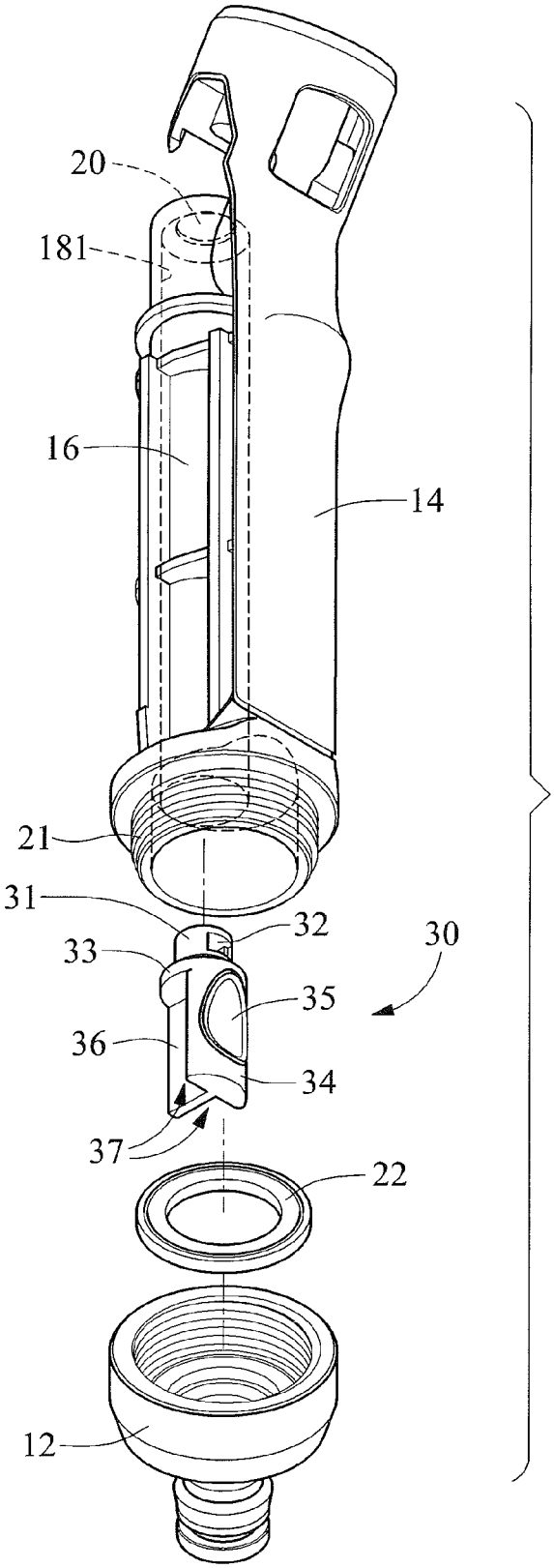
FIG. 4 is a partial and exploded view of the sprinkler shown in FIG. 1.

Referring to FIGS. 3 and 4, a main channel 18 axially extends throughout the tube 16. The tube 16 includes a ceiling 19 made with an aperture 20 in communication with the main channel 18. The diameter of the aperture 20 is smaller than that of the main channel 18. The tube 16 is formed with a thread 21 near a lower end. The thread 21 is engaged with a thread (not numbered) formed on an internal face of the joint 12 so that the handle 11 is connected to the joint 12. A sealing ring 22 is arranged between the handle 11 and the joint 12. In operation, the joint 12 is fitted in an open end of a hose (not shown) so that water can go into the tube 16 from the hose through the joint 12. An annular flange 23 extends on and around the tube 16 near the upper end of the tube 16.

The valve 30 includes a connective portion 31, a positioning portion 33, a gate 34, a sealing strip 35 and a plate 36. The connective portion 31, the positioning portion 33, the gate 34 and the plate 36 are made in one piece. The gate 34 is a semi-circular rod that includes an arched face and a flat face. The sealing strip 35 is made of an elastic material and attached to the arched face of the gate 34. The plate 36 extends from the flat face of the gate 34. The positioning portion 33 is formed at an upper edge of the gate 34 and an upper edge of the plate 36. The connective portion 31 is formed on an upper face of the positioning portion 33. The connective portion 31 includes a bore 32 extending therein in a radial manner and a positioning recess 39 in communication with the bore 32.

Referring to FIGS. 3, 4, 7 and 10, the valve 30 is inserted into the tube 16 and, more particularly, the main channel 18 via a lower open end of the main channel 18. The valve 30 is substantially located near an upper end of the tube 16. The connective portion 31 extends out of the tube 16 via the aperture 20. The positioning portion 33 of the valve 30 is abutted against the ceiling 19 of the tube 16. A sealing ring 38 is arranged between the ceiling 19 and the position portion 33. The plate 36 divides the main channel 18 into to two channels 37.

Figure 7:
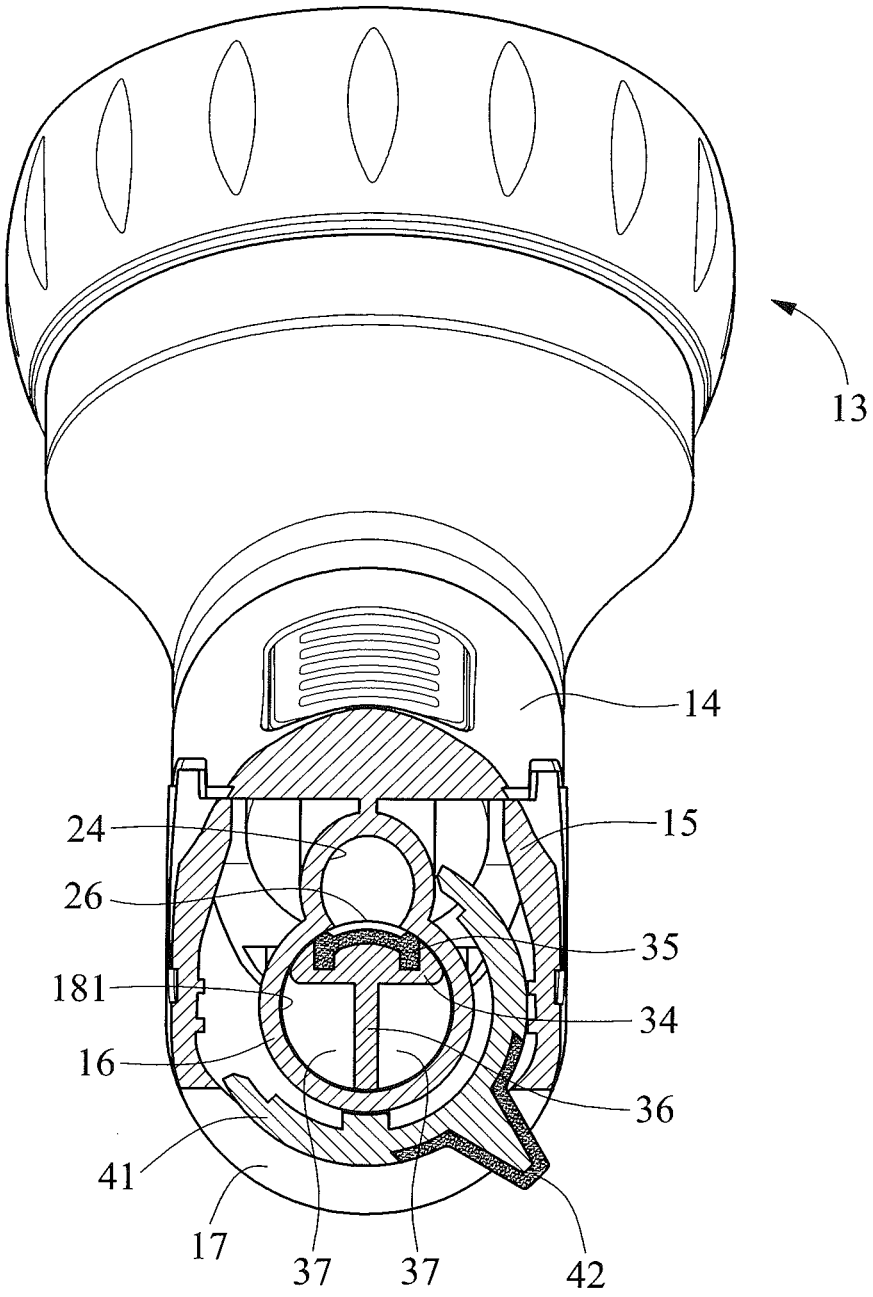
FIG. 7 is a cross-sectional view of the sprinkler taken along a line VII-VII shown in FIG. 6.

Referring to FIGS. 3, 4 and 7, a periphery of the positioning portion 33, the arched face of the gate 34, a face of the sealing strip 35 and an edge of the plate 36 are in contact with an internal face 181 of the main channel 18 of the tube 16 to ensure that the valve 30 is precisely positioned in the main channel 18 in an angular sense, in an axial sense and in a radial sense. The plate 36 enhances the strength of the gate 34, thereby rendering the gate 34 less vulnerable to deformation. Thus, the gate 34 cannot be pivoted toward a center of the valve 30.

Figure 5:
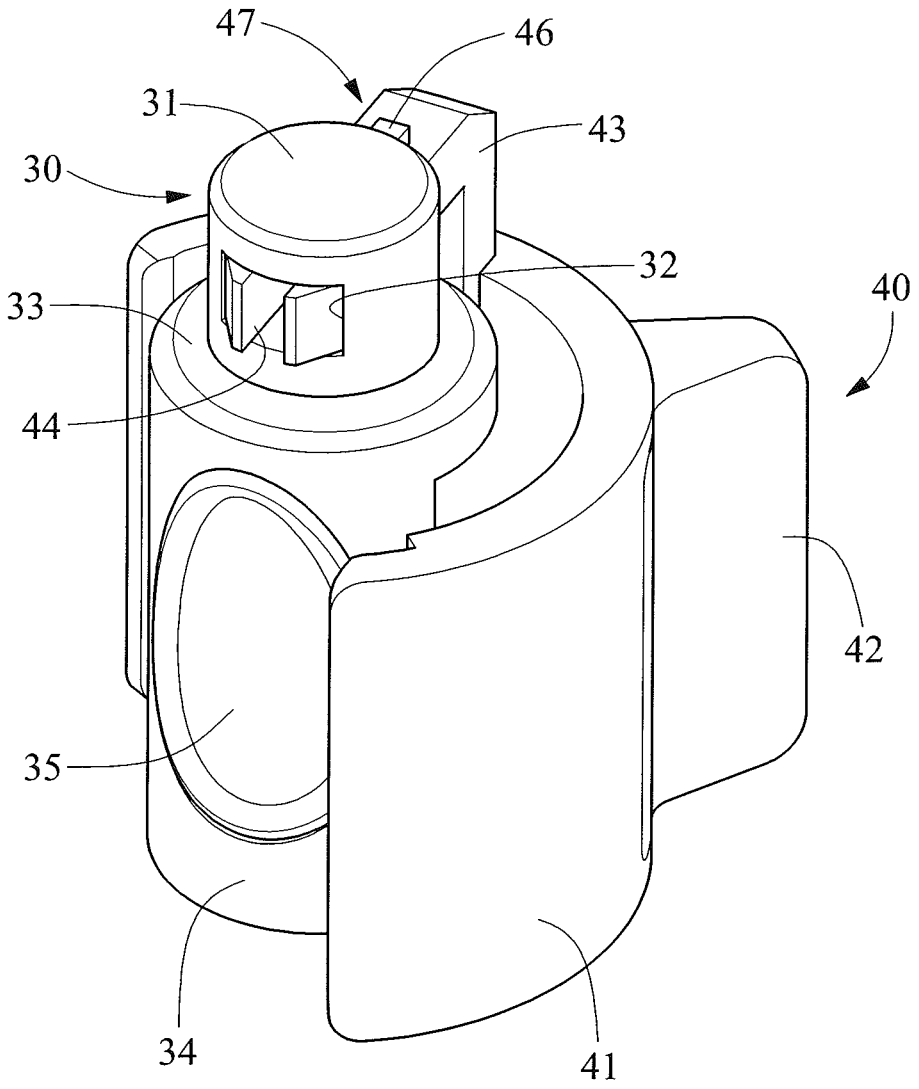
FIG. 5 is a perspective view of a valve and a switch of the sprinkler shown in FIG. 1.
Figure 11:
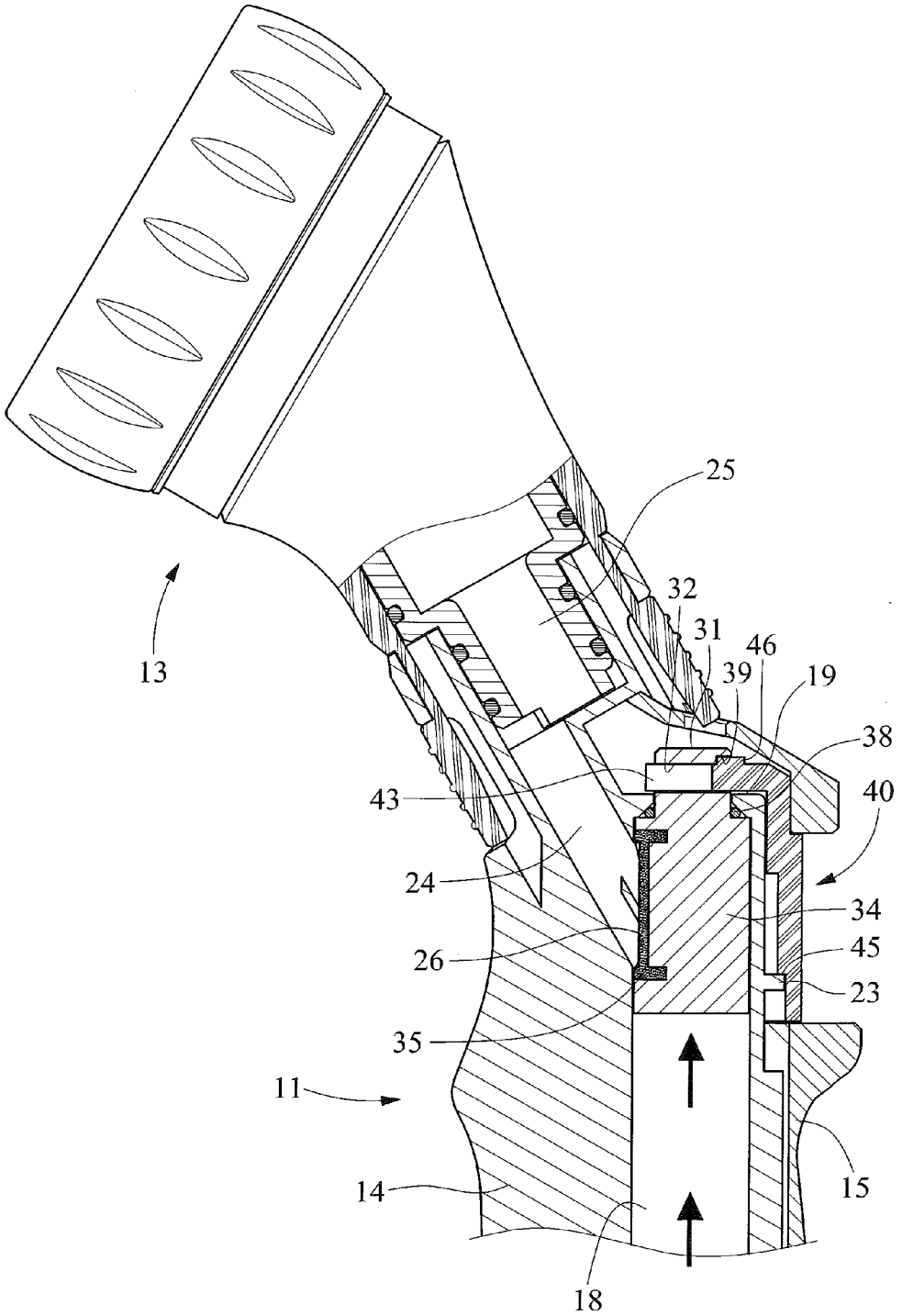
FIG. 11 is a partial view of the sprinkler in another position than shown in FIG. 10.

Referring to FIGS. 3, 5 and 11, the switch 40 includes a wall 41, a fin 42, a shoulder 45 and a connector 47. The wall 44 is in an arched configuration of about 180 degrees. The fin 42 is formed on a first arched face of the wall 41. Preferably, the fin 42 is located in a middle portion of the first arched face of the wall 41. The shoulder 45 is formed on a second arched face of the wall 41.

The connector 47 includes a stem (not numbered), a pin 43, two hooks 44 and a positioning boss 46. The stem extends from an upper edge of the wall 41. Preferably, the stem does not extend a middle portion of the upper edge of the wall 41. The pin 43 transversely extends from the stem. The hooks 44 longitudinally extend from the pin 43. The hooks 44 are separated by a gap (not numbered) so that they can be elastically pivoted toward each other. The positioning boss 46 is formed on the pin 43.

The pin 43 of the connector 47 is inserted in the bore 32 of the valve 30. The hooks 44 are engaged with the connective portion 31. Thus, the pin 43 is kept in the bore 32. The shoulder 45 is abutted against the annular flange 23. Thus, the switch 40 is allowed to smoothly rotate around the tube 16. The positioning boss 46 is inserted in the positioning recess 39.

Figure 6:
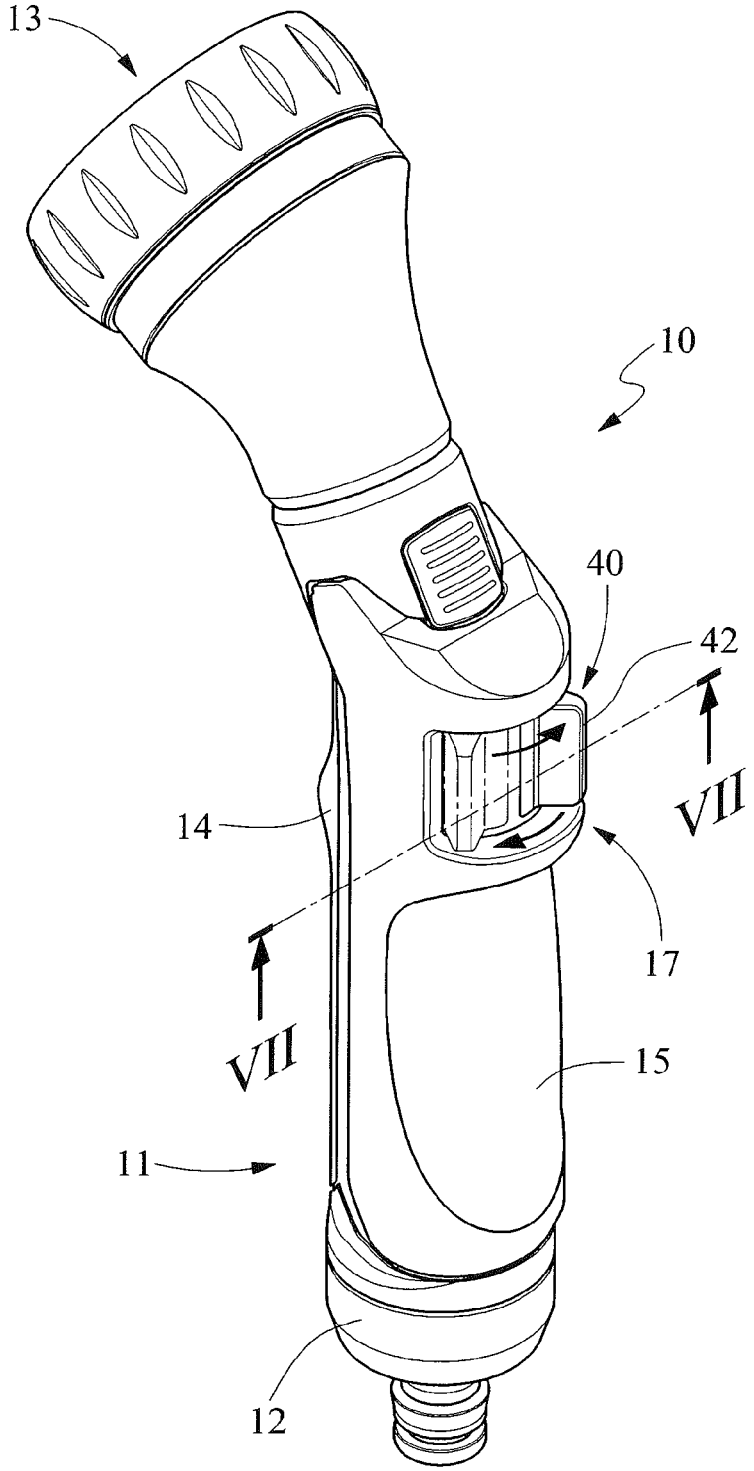
FIG. 6 is a rear perspective view of the sprinkler of FIG. 1.

Referring to FIG. 6, the fin 42 of the switch 40 is visible via the window 17 of the second shell 15. Thus, a user is allowed to hold the handle 11 with a hand and operate the fin 42 to slide and rotate the switch 40 with a finger. In turn, the pin 43 of the switch 40 rotates the valve 30 in the tube 16.

Referring to FIGS. 7 to 11, the tube 16 further includes an inclined extensive channel 24 in communication with the main channel 18 at an intersection 26. The extensive channel 24 is in communication with a channel 25 made in the nozzle 13.

Referring to FIGS. 7 and 11, the fin 42 is located at a first end in the window 17 so that the gate 34 is aligned with the intersection 26 between the main channel 18 and the extensive channel 24. Now, the sealing strip 35 completely blocks the intersection 26. Water cannot go into the extensive channel 24 from the main channel 18. Hence, no water goes out of the nozzle 13.

Figure 9:
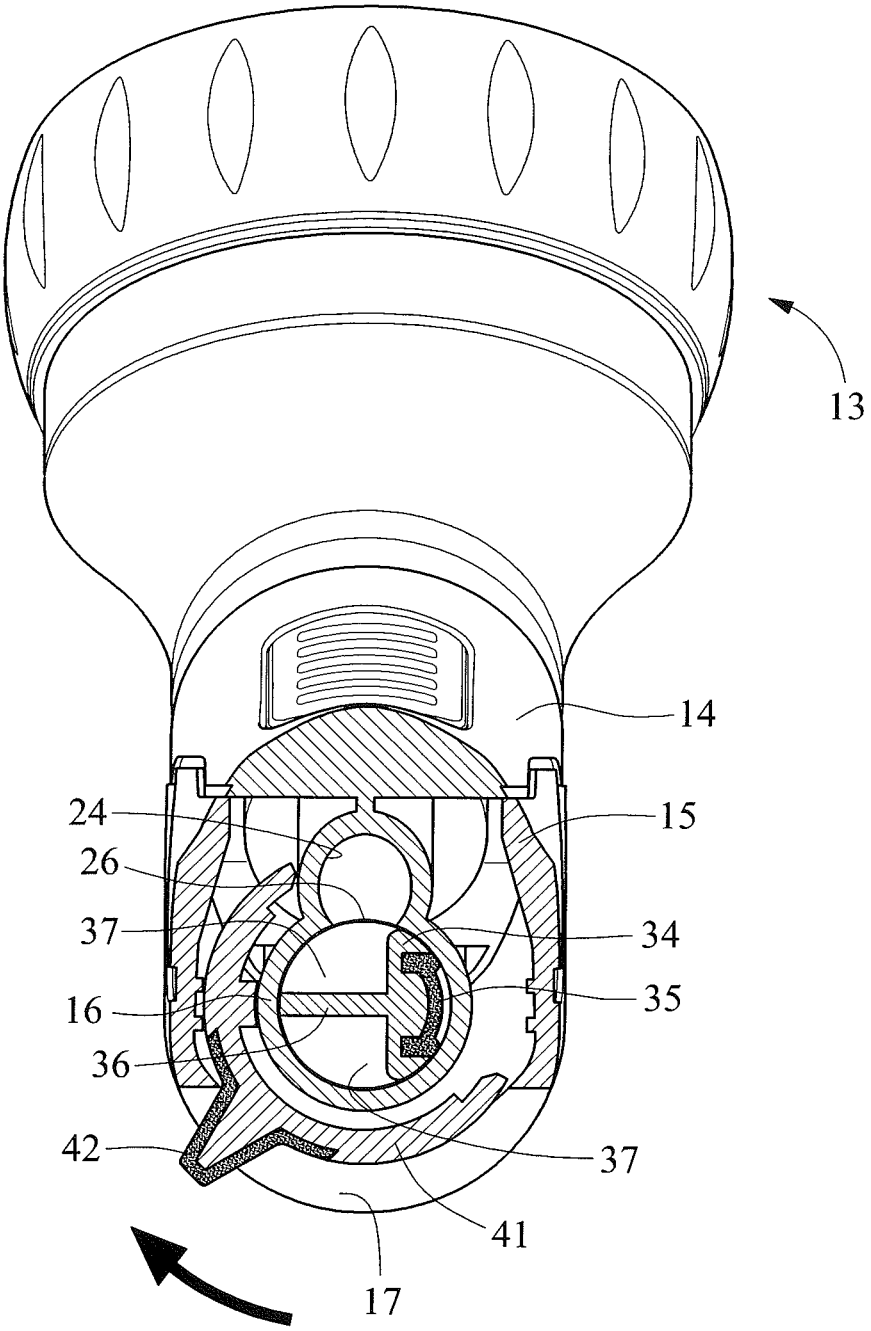
FIG. 9 is a cross-sectional view of the sprinkler in another position than shown in FIG. 8.
Figure 10:
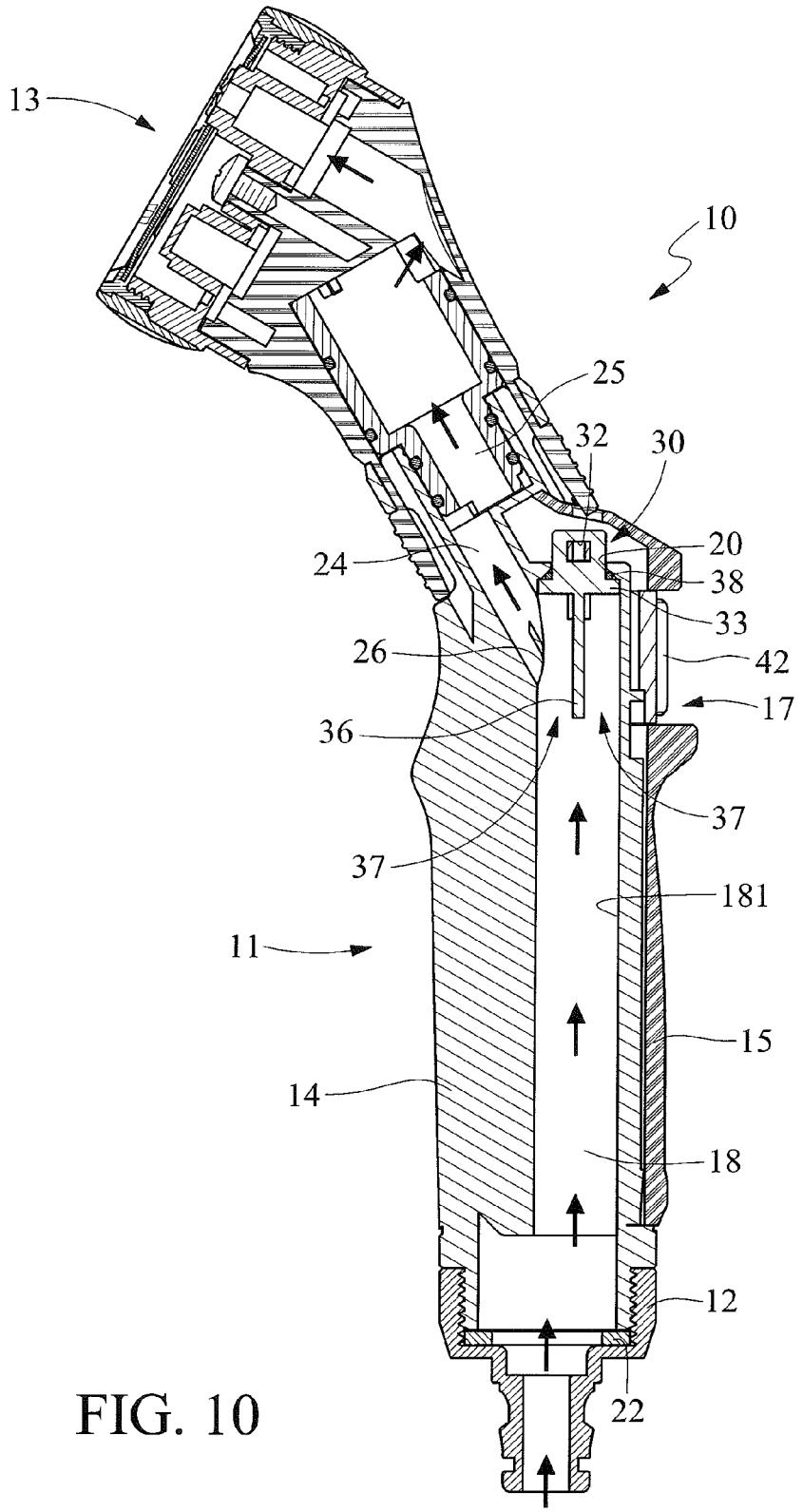
FIG. 10 is another cross-sectional view of the sprinkler in another position than shown in FIG. 7.

Referring to FIGS. 9 and 10, the fin 42 is located at a second end of the window 17 so that the gate 34 is completely located out of the intersection 26. Now, the channels 37 are aligned with the intersection 26. Thus, the intersection 26 is completely opened to communicate the main channel 18 with the extensive channel 24 to allow the water to go into the extensive channel 24 from the main channel 18. Finally, the water goes out of the nozzle 13.

Figure 8:
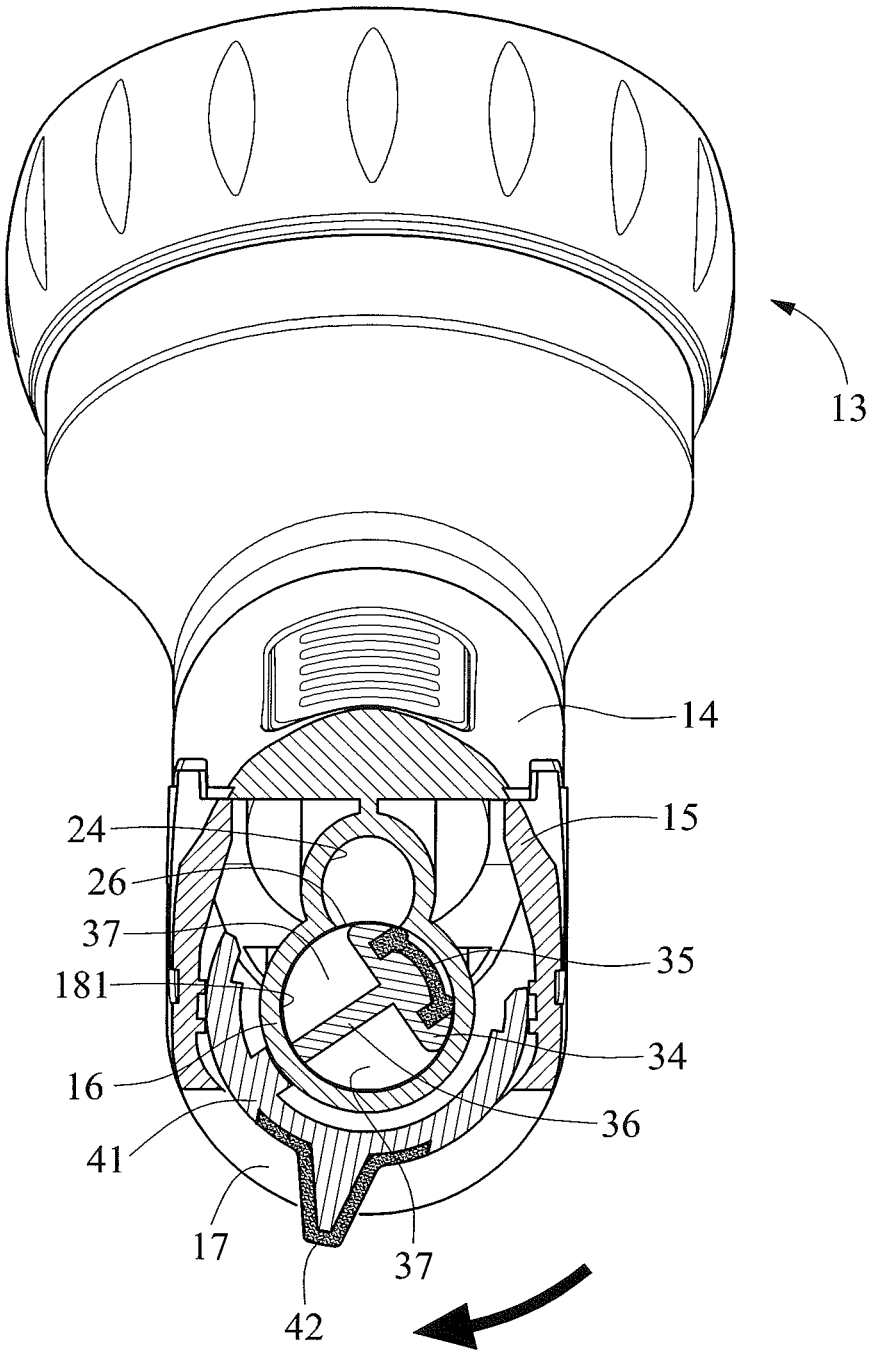
FIG. 8 is a cross-sectional view of the sprinkler in another position than shown in FIG. 7.

Referring to FIG. 8, the fin 42 is located between the first and second ends of the window 17 so that the gate 34 partially blocks the intersection 26, the channels 37 are partially in communication with the intersection 26. That is, the intersection 26 is partially opened to allow the water to go into the extensive channel 24 from the main channel 18 at a rate lower than shown in FIG. 9.

Referring to FIGS. 7 through 9, the switch 40 and the valve 30 are continuously rotatable to allow continuous adjustment of the degree of openness of the intersection 26 between the completely opened status and the completely closed status. Hence, allowed is continuous adjustment of the rate of providing water from the sprinkler 10 between the highest rate shown in FIG. 9 and the lowest rate shown in FIG. 7.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A sprinkler comprising
- a handle (11);
- a nozzle (13) connected to the handle (11);
- a tube (16) made in the handle (11) and formed with a window (17), a main channel (18) in communication with a channel (25) made in the nozzle (13), an extensive channel (24) and an intersection (26) via which the extensive channel (24) is in communication with the main channel (18);
- a valve (30) comprising a gate (34), a positioning portion (33) formed on the gate (34), and a connective portion (31) formed on the positioning portion (33), wherein the valve (30) is rotationally inserted in the main channel (18) so that the connective portion (31) extends out of the tube (16); and
- a switch (40) comprising:
  - an arched wall (41) comprising an arched face and an arched edge;
  - a fin (42) formed on the arched face of the wall (41); and
  - a connector (47) formed on an upper edge of the wall (41) and connected to the connective portion (31) of the valve (30) so that the switch (40) is movable with the valve (30), wherein the fin (42) is movable in the window (17), wherein the gate (34) completely blocks the intersection (26) as the fin (42) is located in an end of the window (17), wherein the gate (34) completely opens the intersection (26) when the fin (42) is located in another end of the window (17), wherein the gate (34) partially opens the intersection (26) as the fin (42) is located between the ends of the window (17).

2. The sprinkler according to claim 1, wherein the tube (16) comprises a ceiling (19) made with an aperture (20) in communication with the main channel (18), wherein the aperture (20) is made with a diameter smaller than that of the main channel (18), wherein the connective portion (31) of the valve (30) extends out of the tube (16) via the aperture (20), wherein the positioning portion (33) of the valve (30) is abutted against the ceiling (19).

3. The sprinkler according to claim 2, wherein the valve (30) comprises a sealing ring (38) arranged between the positioning portion (33) and the ceiling (19).

4. The sprinkler according to claim 1, wherein the valve (30) comprises a sealing strip (35) attached to the gate (34) in contact with an internal face of the tube (16).

5. The sprinkler according to claim 1, wherein the valve (30) comprises a plate (36) having an upper edge connected to a lower face of the positioning portion (33) and a lateral edge connected to a flat face of the gate (34).

6. The sprinkler according to claim 1, wherein the valve (30) comprises a bore (32) in the connective portion (31), wherein the connector (47) comprises a pin (43) inserted in the bore (32).

7. The sprinkler according to claim 6, wherein the connector (47) comprises two hooks (44) formed at an end of the pin (43) and engaged with the connective portion (31) of the valve (30).

8. The sprinkler according to claim 6, wherein the fin (42) is located at a middle portion of the arched face of the wall (41), wherein the pin (43) is biased from a middle portion of the arched edge of the wall (41).

9. The sprinkler according to claim 6, wherein the connective portion (31) of the valve (30) comprises a positioning recess (39) in communication with the bore (32), wherein the pin (43) comprises a positioning boss (46) inserted in the positioning recess (39).

10. The sprinkler according to claim 1, wherein the tube (16) comprises an annular flange (23) formed thereon, wherein the wall (41) comprises a shoulder (45) abutted against the annular flange (23).

* * * * *